US006739889B1

(12) United States Patent
Daggett et al.

(10) Patent No.: US 6,739,889 B1
(45) Date of Patent: May 25, 2004

(54) ELECTRICAL DISTRIBUTION CENTER ASSEMBLY

(75) Inventors: Barry M Daggett, Canfield, OH (US); Randall S Cvelbar, Hubbard, OH (US); Raymond J. Blasko, Boardman, OH (US); Dale M Higginbotham, Parma, OH (US); Michael R. Croutch, Youngstown, OH (US); Ronald Allen Baldwin, Cortland, OH (US); Donald John Mizner, Sharpsville, PA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/448,683

(22) Filed: May 30, 2003

(51) Int. Cl.[7] ..... H01R 13/62
(52) U.S. Cl. ..... 439/157; 439/372
(58) Field of Search ..... 439/157, 152, 439/153, 342, 372, 376, 159, 160

(56) References Cited

U.S. PATENT DOCUMENTS

| | | | | |
|---|---|---|---|---|
| 5,569,040 A | * | 10/1996 | Sumida | 439/157 |
| 5,788,529 A | | 8/1998 | Borzi et al. | 439/364 |
| 6,077,102 A | | 6/2000 | Borzi et al. | 439/76.2 |
| 6,126,458 A | | 10/2000 | Gregory, II et al. | 439/76.2 |
| 6,150,734 A | | 11/2000 | Neibecker et al. | |
| 6,220,876 B1 | | 4/2001 | Avila et al. | |
| 6,244,886 B1 | | 6/2001 | Strang et al. | |
| 6,247,973 B1 | | 6/2001 | Chawa et al. | |
| 6,361,336 B1 | * | 3/2002 | Zhao et al. | 439/157 |
| 6,435,910 B1 | | 8/2002 | Blasko et al. | |
| 6,443,779 B2 | | 9/2002 | Suzuki | 439/701 |
| 6,468,091 B2 | | 10/2002 | Roussel et al. | |
| 6,500,015 B2 | * | 12/2002 | Fukamachi et al. | 439/157 |
| 6,547,574 B2 | * | 4/2003 | Sasaki et al. | 439/157 |
| 6,547,586 B2 | | 4/2003 | Adduci | |
| 2003/0068910 A1 | * | 4/2003 | Casses | 439/157 |

* cited by examiner

*Primary Examiner*—Hien Vu
(74) *Attorney, Agent, or Firm*—David P. Wood

(57) ABSTRACT

The present invention provides an electrical distribution center assembly and a method of constructing the same. The electrical distribution center assembly includes an electrical distribution center member, an electrical connector, a support member which retains the electrical connector and includes at least one cam follower projection, at least one cam lever rotatably mounted to the electrical distribution center member, and a driver member for abutting the cam lever arm. An engagement movement of the driver member causes the cam lever to rotate and engage the cam follower projection thereby multiplying an engagement force to draw together the electrical distribution center member and the electrical connector against a resistance. The cam lever also leverages a disengagement force applied to the driver member to separate the electrical distribution center from the electrical connector.

25 Claims, 10 Drawing Sheets

ELECTRICAL DISTRIBUTION CENTER ASSEMBLY

TECHNICAL FIELD

The present invention generally relates to electrical distribution center assemblies, and more particularly to electrical distribution center assemblies including electrical distribution center member/electrical connector/support combinations having mechanisms for multiplying engagement and disengagement forces.

INCORPORATION BY REFERENCE

U.S. Pat. No. 5,788,529 to Borzi, et al., which is assigned to the assignee of the present invention, is hereby incorporated by reference herein in order that electrical distribution centers need not be described in detail herein.

BACKGROUND OF THE INVENTION

Electrical distribution centers are widely used. The electrical distribution center is a central junction box or block system designed as a stand-alone assembly. This junction block can package various fuses, relays and other electrical devices in a central location. Electrical distribution centers not only reduce costs by consolidating various functions into one block, but the centers also reduce the number of cut and spliced leads which helps to increase reliability. Such electrical distribution centers include provisions for electrically connecting a power source and electrical devices housed in the junction block to electrical wiring harness connectors for supplying power and control signals to various electrical systems.

In many applications, such as where electrical distribution centers are used in an underhood engine compartment of a vehicle, the electrical distribution center assemblies are oriented so that devices such as fuses and relays are accessible from the top and mating connectors protrude from a bottom side. Due to this orientation, access to the connectors is often difficult for mating and unmating. In many cases, the electrical distribution center has to be flipped upside down, the connectors assembled, and the entire assembly with protruding wire harnesses flipped again into a final position.

The previously cited '529 patent to Borzi, et al. describes an electrical distribution center assembly which includes an electrical distribution center, a wire harness connector, and a connector retainer carried by a vehicle for temporarily holding the wire harness in position while the wire harness connector is bolted to the electrical distribution center.

SUMMARY OF THE INVENTION

The present invention provides alternatives and advantages over the prior art. A preferred embodiment of the invention comprises a mechanism for multiplying forces for connecting and disconnecting an electrical distribution center member and at least one electrical connector without requiring the use of a bolt or assembly tooling and without requiring the electrical distribution center member to be flipped over.

The preferred embodiment of the electrical distribution center assembly includes an electrical distribution center member, a driver member, a connector support member, electrical connectors attached to the support member, and cam levers rotatably attached to side walls of the electrical distribution center member.

In the preferred embodiment, the cam levers enable an 11:1 mechanical advantage. This mechanical advantage generated by the cam levers causes a force applied to the driver member to be significantly multiplied, thereby generating a much greater force urging the electrical distribution center member toward the electrical connectors. As a result, an assembly operator can assemble the electrical distribution center member to the electrical connectors without the use of any special tooling.

The preferred embodiment provides a cam lever which includes a cam track having two track portions. One portion enables an upward movement of the driver member to draw the electrical distribution center member toward the electrical connectors. The second portion enables a downward movement of the driver member to further draw the electrical distribution center member toward the electrical connectors until they are mated.

The preferred embodiment includes guidance and alignment features which facilitate assembly of the electrical distribution center member to the electrical connectors in a controlled manner along a connection axis.

In the preferred embodiment, an upward force applied to the driver member causes each of the cam levers to rotate creating a multiplied force urging the electrical distribution center member and mated electrical connectors apart.

These and other features and advantages of the present invention will become apparent from the following brief description of the drawings, detailed description, and appended drawings.

BRIEF DESCRIPTION OF THE DRAWINGS

The present invention will now be described, by way of example, with reference to the accompanying drawings, in which.

DETAILED DESCRIPTION OF THE INVENTION

Figure 1:
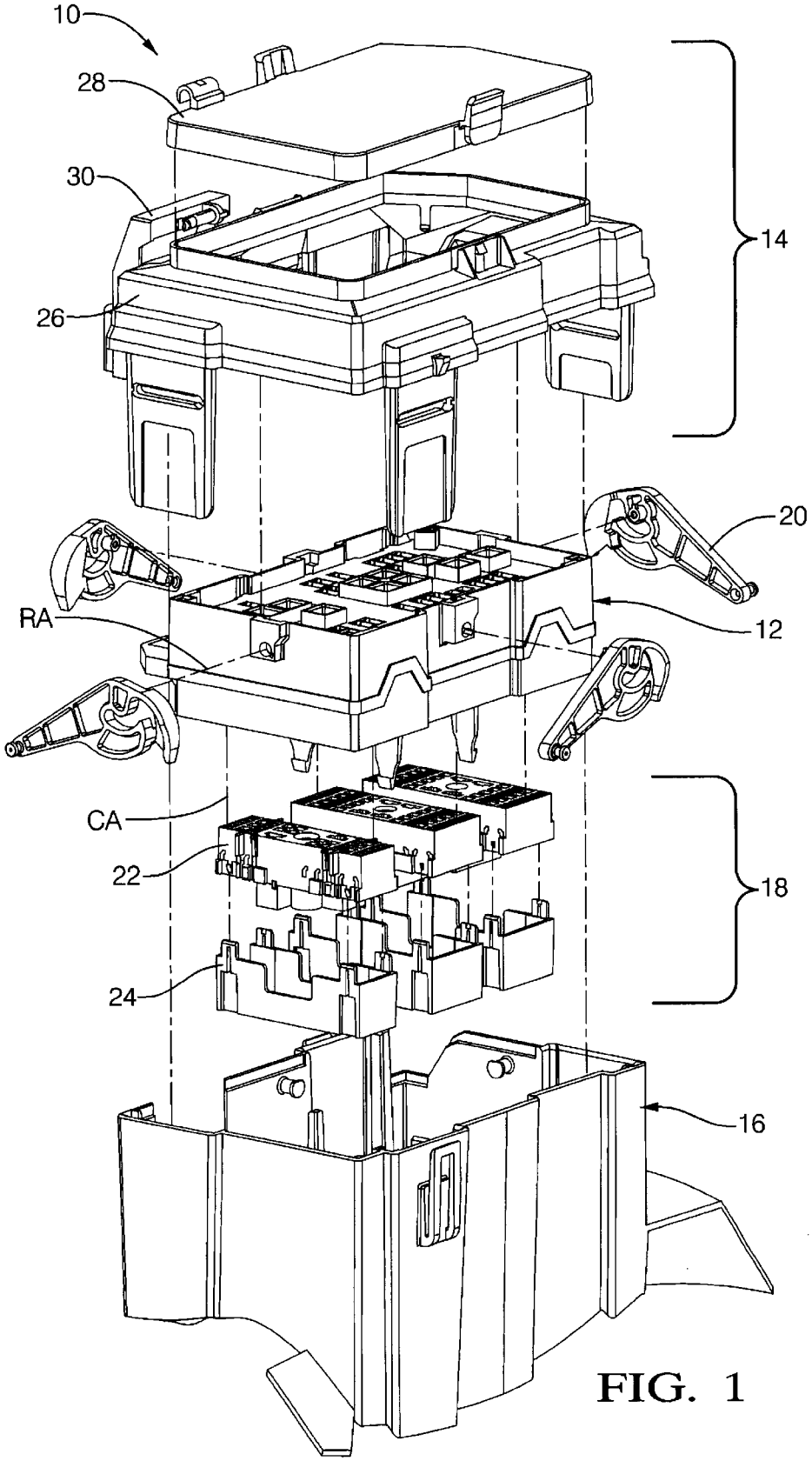
FIG. 1 is an exploded perspective view of an electrical distribution center assembly of the present invention.

Referring to the figures wherein like numerals refer to like elements throughout the several views, FIG. 1 illustrates a preferred embodiment of an electrical distribution center assembly 10 of the present invention including an electrical distribution center member 12, a driver member 14, a connector support member 16, electrical connector assemblies 18 (three shown), and four spaced apart cam levers 20. Each electrical connector assembly 18 includes an electrical connector 22 and a wire dressing cover 24. The driver member 14 includes an upper housing 26, an electrical distribution center cover 28, and a cover 30 for a stud terminal (not shown).

The electrical distribution center member 12 electrically connects to each electrical connector assembly 18 along a connection axis CA. Each cam lever 20 is rotatably attached to the electrical distribution center member 12 along a respective rotation axis RA. Each rotation axis RA extends orthogonally relative to the connection axis CA.

Figure 2:
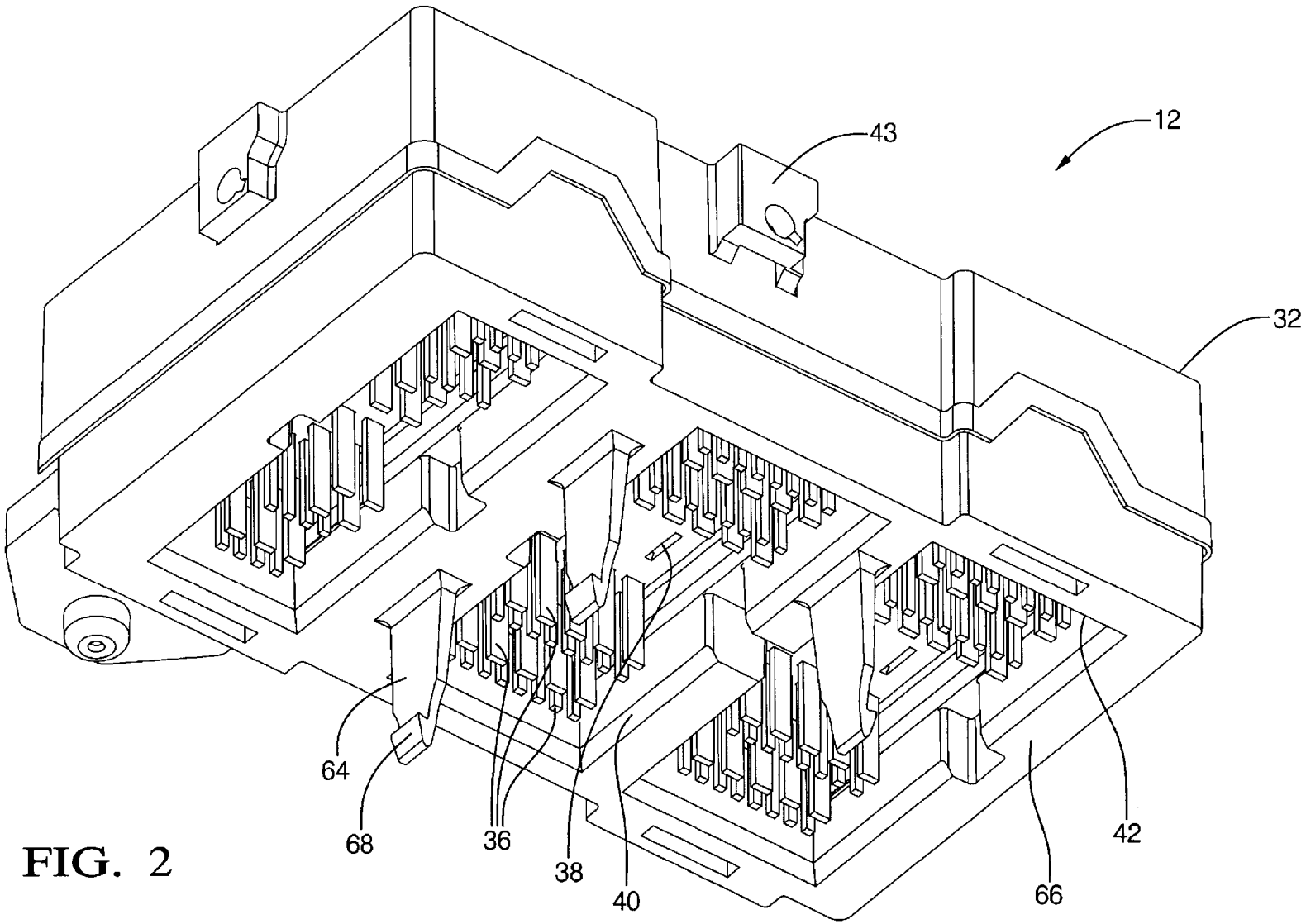
FIG. 2 is a perspective view of an electrical distribution center member of the present invention.
Figure 3:
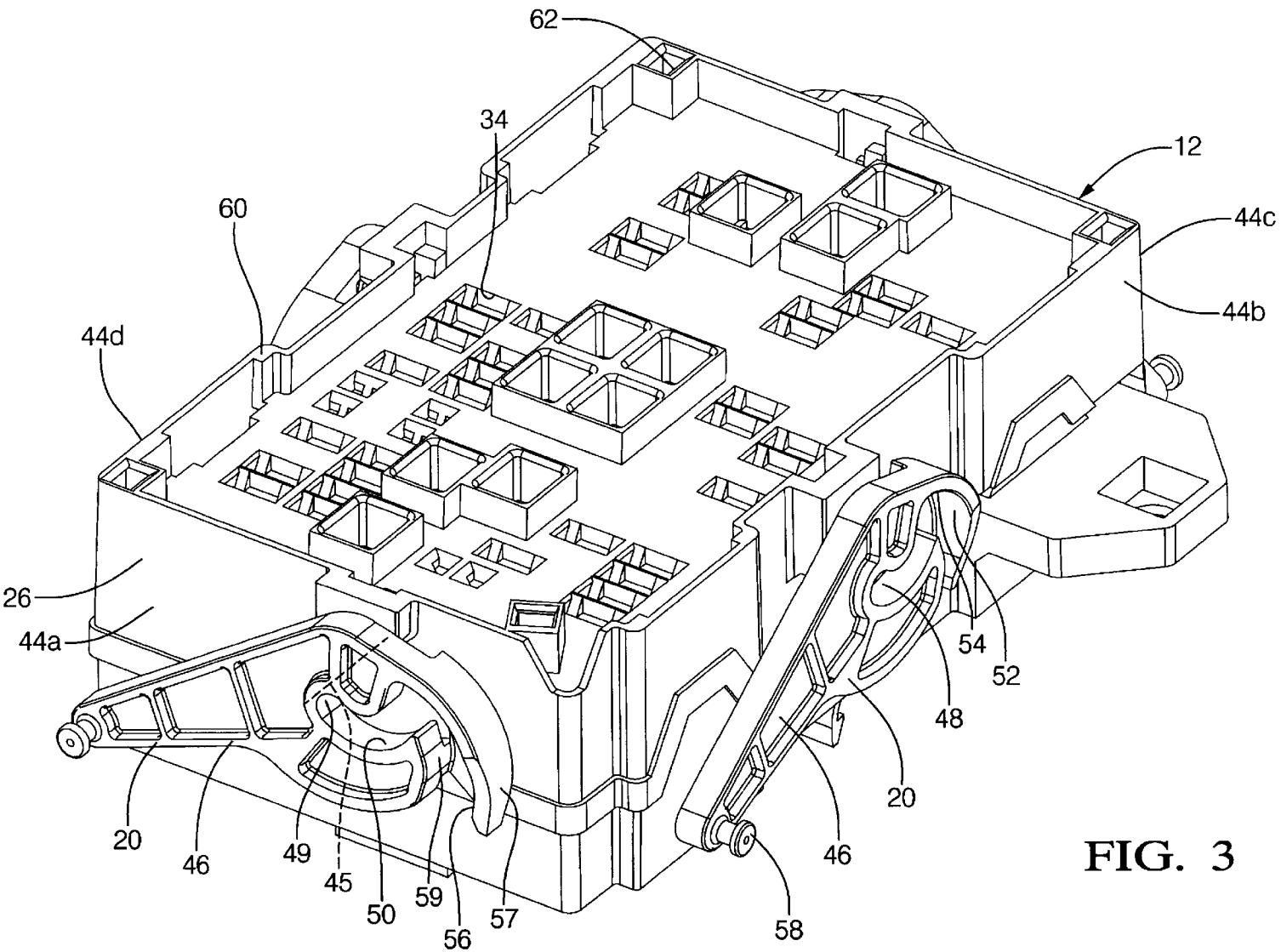
FIG. 3 is a perspective view of one aspect of the present invention.

As shown in FIGS. 2 and 3, the electrical distribution center member 12 includes an insulative housing 32. Fuses, relays, or other electrical components (not shown) can be plugged into cavities 34 formed in the housing 32. A plurality of male blades 36 extend downwardly through slots 38 formed in housing 32. The housing 32 defines connector shrouds 42 (three shown) each forming a socket for receiving a respective one of the electrical connectors 22. Each of the connector shrouds 42 functions to maintain the electrical connectors 22 in alignment along the connection axis CA with the electrical distribution center member 12 during mating. An opening to each of the connector shrouds 42 is defined by a chamfered rim 40 which functions to bring the connector shrouds 42 into alignment with the electrical connectors 22 during mating.

Interior portions of the electrical distribution center member 12 and the support member 16 are not described in detail herein. These may be designed as necessary by those skilled in the art to meet the requirements of a particular application. The previously cited '529 patent to Borzi, et al. provides a description of an interior portion of an electrical distribution center member and a support member. Many other configurations may be used.

Figure 4:
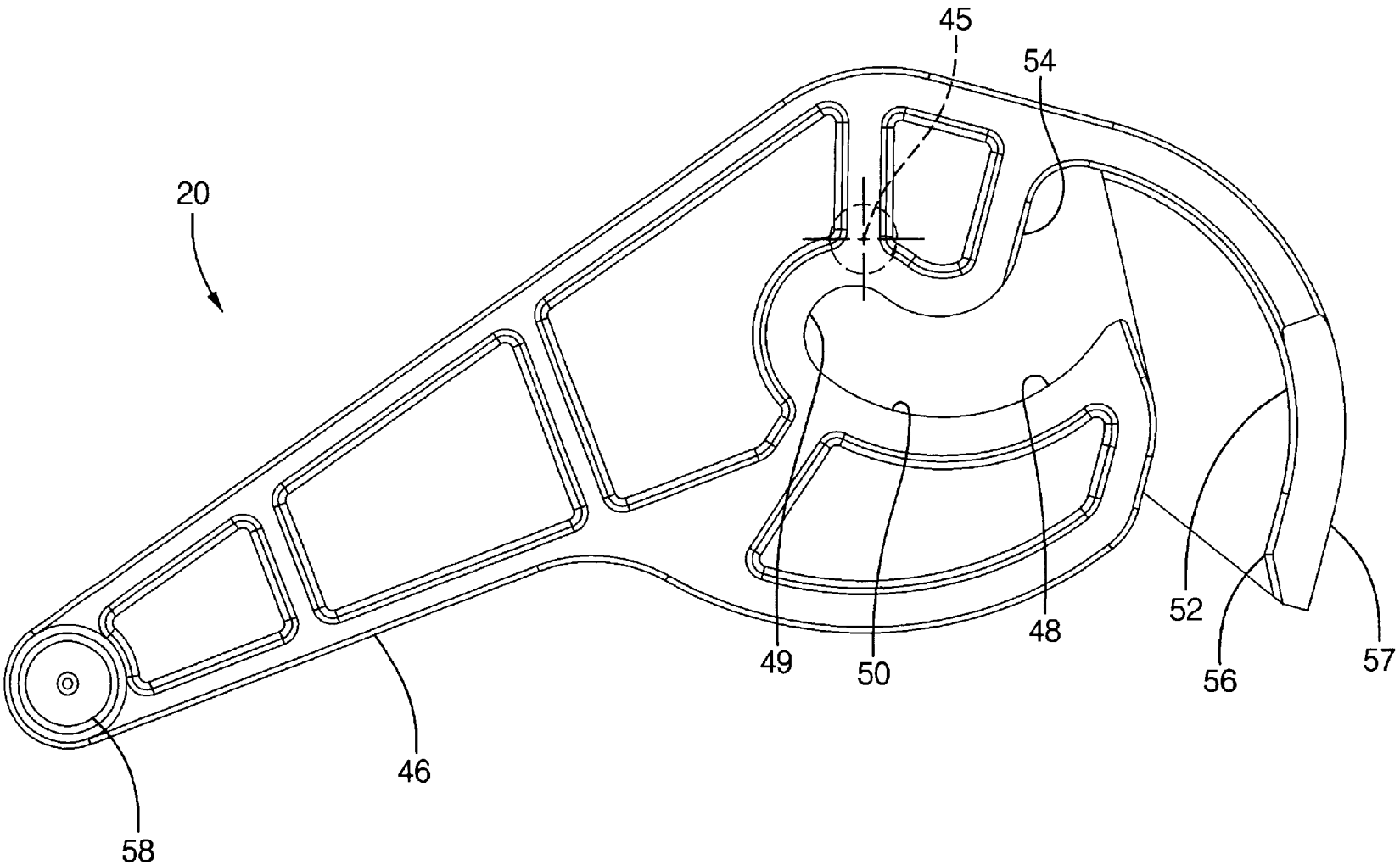
FIG. 4 is a plan view of a cam lever of the present invention.

Each cam lever 20 is rotatably attached to a respective mounting platform 43 formed in each of four side walls 44*a*, 44*b*, 44*c*, 44*d* of the electrical distribution center member 12 housing 32. Each cam lever 20 is attached to the respective mounting platform 43 at a rotational center 45 of the cam lever 20. As shown in FIGS. 3 and 4, the cam lever 20 includes an arm 46. A slot or cam track 48 is formed in the cam lever 20. The cam track 48 includes a cam track end surface 49, a first track portion 50, a second track portion 52 in communication with the first track portion 50, a second track portion end surface 54, and an opening 56. The second track portion 52 generally forms a partial revolution of a spiral which gradually approaches the rotational center 45 as it curves from the opening 56 toward the second track portion end surface 54. The first track portion 50 generally forms a partial revolution of a spiral which gradually approaches the rotational center 45 as it curves from the second track portion 52 to the cam track end surface 49. The second track portion 52 is partially defined by a hook portion 57 of the cam lever 20. A slot 59 (shown on FIG. 3) is formed in the cam lever 20 along the second track portion 52. The lever arm 46 includes a boss 58 for engagement with the driver member 14. Each boss 58 includes a body 58*a* and an enlarged head 58*b* having an increased diameter relative to the body 58*a*.

As shown in FIG. 3, a top surface 60 of the electrical distribution center member 12 includes first pre-stage lock receiving sockets 62. Second pre-stage lock arms 64 extend downwardly from a bottom surface 66 of the electrical distribution center member 12. Each second pre-stage lock arm 64 includes a shoulder 68 at a free end.

Figure 5:
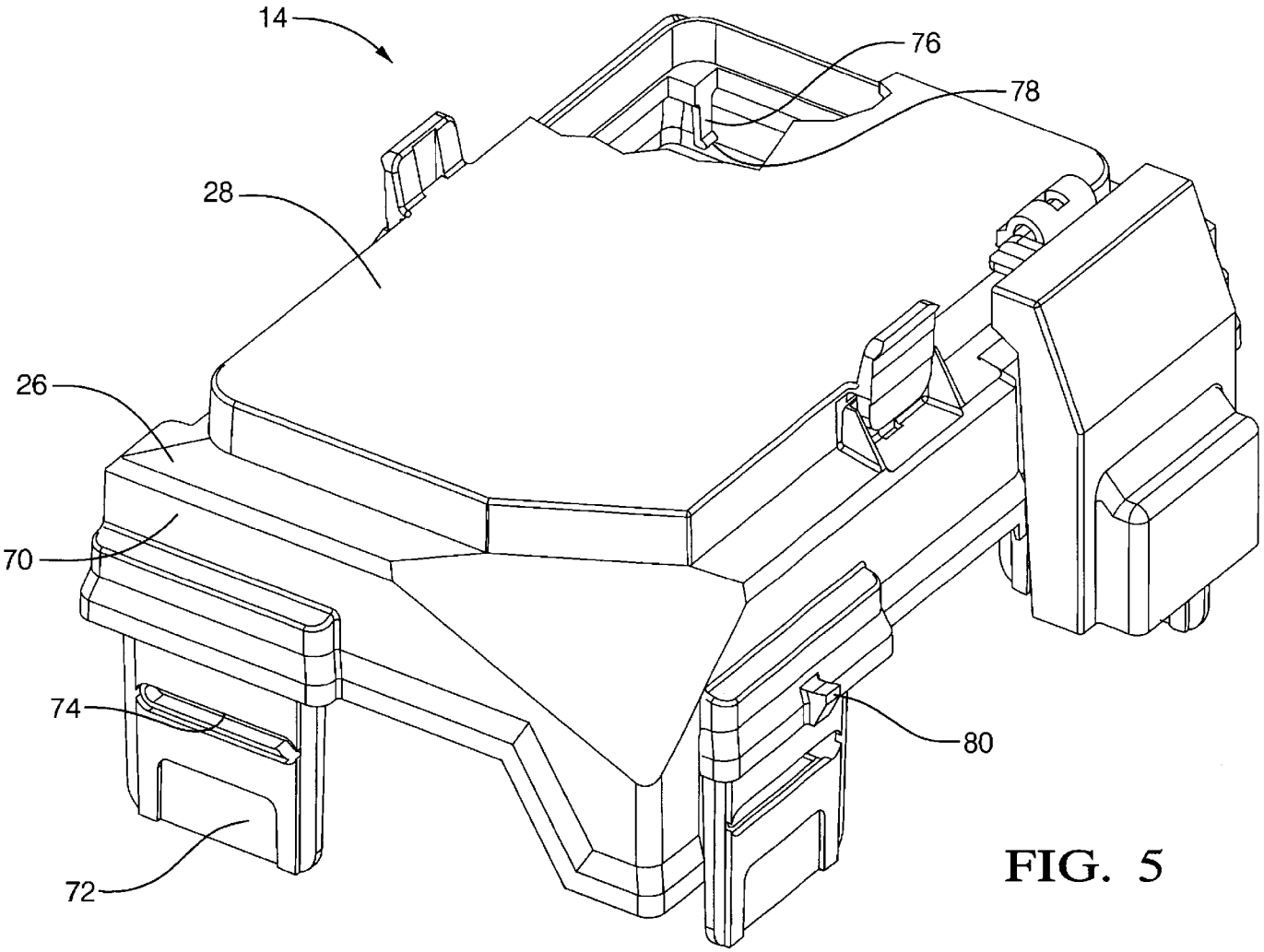
FIG. 5 is a perspective view of a driver member of the present invention.

As shown in FIG. 5, side portions 70 of the upper housing 26 include downward extending alignment projections 72. Horizontally extending slots 74 are formed in each alignment projection 72 for engagement with the boss 58 formed in the cam lever 20. Each slot 74 extends orthogonally relative to the connection axis CA and the rotation axis RA of the corresponding cam lever 20. Each slot 74 has an enlarged opening 75 for receiving the enlarged head 58*b* of the boss 58. The slot 74 has a width which is narrower than the enlarged head 58*b* to prevent the boss 58 from disengaging from the slot 74 during operation. The electrical distribution center cover 28 is releasably latched to the upper housing 26. The upper housing 26 includes downward extending first pre-stage lock arms 76, each with a shoulder 78 at a free end, for releasably engaging the first pre-stage lock receiving sockets 62. Latch nibs 80 extend outwardly from the side portions 70 of the upper housing 26. The driver member 14 is engageable with the support member 16 and functions as a cover.

Figure 6:
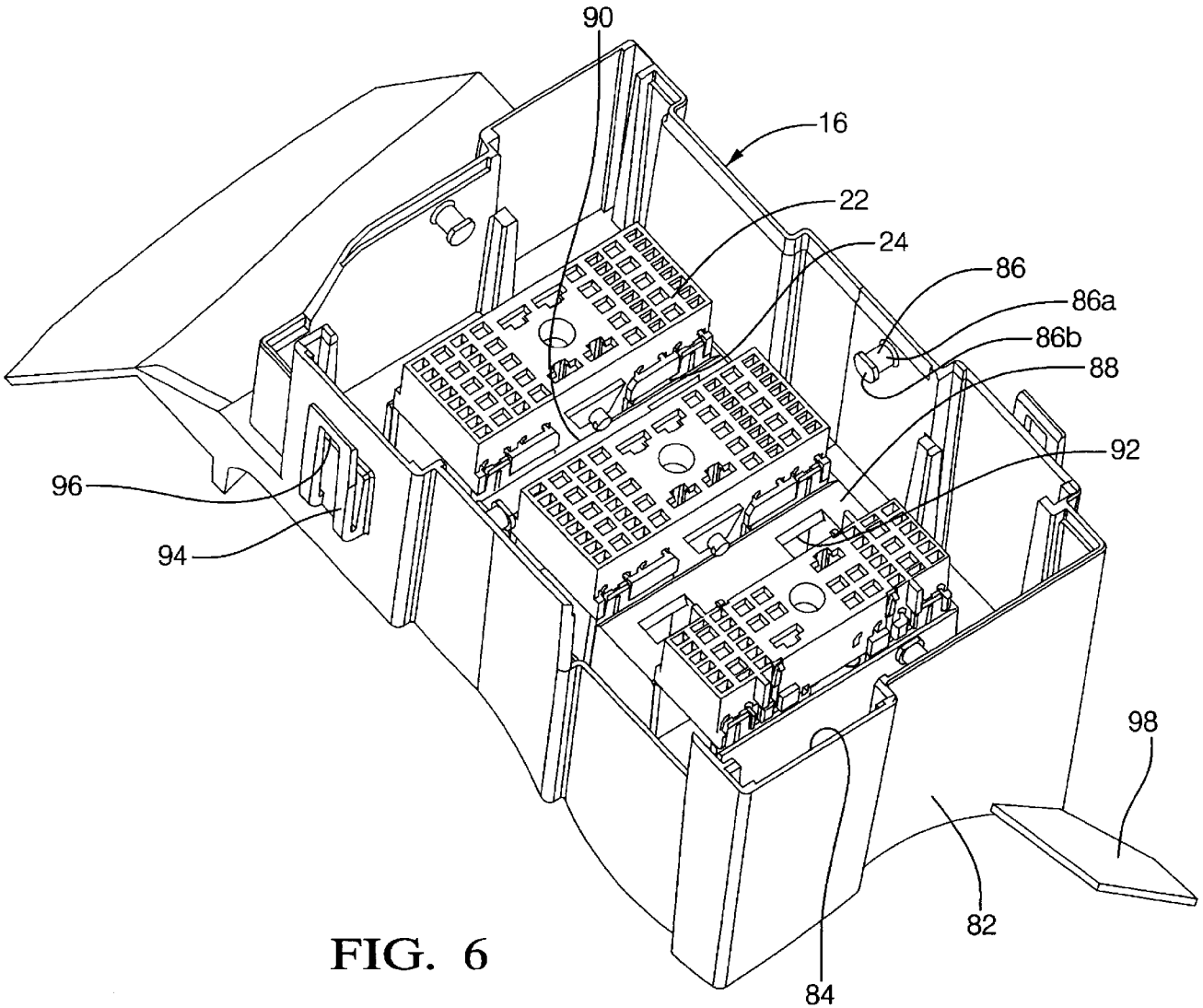
FIG. 6 is a perspective view of a support member of the present invention.

Referring now to FIG. 6, the support member 16 supports the connector assemblies 18 and also functions as a splash shield. The support member 16 includes side walls 82 with guide slots 84 for receiving the downward extending alignment projections 72 of the upper housing 26. Cam guide projections 86 extend inwardly from each of the side walls 82. Each cam guide projection 86 includes a body 86*a* and an enlarged head 86*b* having an increased diameter relative to the body 86*a*. A bottom wall 88 of the support member 16 includes three connector retainers or bays (not shown) formed therein. Each bay (not shown) retains one of the electrical connector assemblies 18. The support member 16 is dimensioned such that a gap 90 (shown on FIG. 9) exists between the support member 16 and the electrical distribution center member 12. Second pre-stage lock receiving sockets 92 are formed in the bottom wall 88 for releasably engaging the shoulder 68 of each of the second pre-stage lock arms 64. The length of each of the second pre-stage lock arms 64 is established to assure that the hook 57 formed in each of the cam levers 20 captures the corresponding cam guide projection 86 during a connecting step when the second pre-stage lock arms 64 engage the second pre-stage lock receiving sockets 92 during a connecting step as further described hereinbelow and illustrated in FIG. 8. The support member 16 includes an upward extending flexible lock arm 94 having a shoulder 96 for releasably engaging the latch nibs 80. The support member 16 also includes outward extending mounting brackets 98.

Each wire dressing cover 24 is secured to a respective one of the connectors 22. Each connector 22 is constructed to receive a bundle of wires (not shown) including a terminal 100 (shown on FIG. 12) at an end of each wire. Each terminal 100 is received in a connector cavity 104. The terminal 100 is preferably a female terminal constructed and arranged for receiving the male blade 36 or other mateable component extending from the electrical distribution center member 12.

A preferred method of assembling the electrical distribution center assembly 10 will now be described. A brief description of the embodiment after each assembly step is also provided.

With the electrical distribution center member 12, the driver member 14, the support member 16, and each of the electrical connector assemblies 18 already constructed, an assembler performs a first pre-stage assembly step. This step includes pivotally attaching each of the cam levers 20 to a respective one of the mounting platforms 43. This step further includes aligning the electrical distribution center member 12 with the driver member 14 then inserting the boss 58 formed on each of the lever arms 46 into the opening 75 of a respective one of the slots 74 formed in the driver member 14. Then, the electrical distribution center member 12 along with the cam levers 20 and the driver member 14 are pushed together engaging the shoulders 78 of the first pre-stage lock arms 76 with the first pre-stage lock receiving sockets 62 forming a first pre-stage combination 102.

Figure 7:
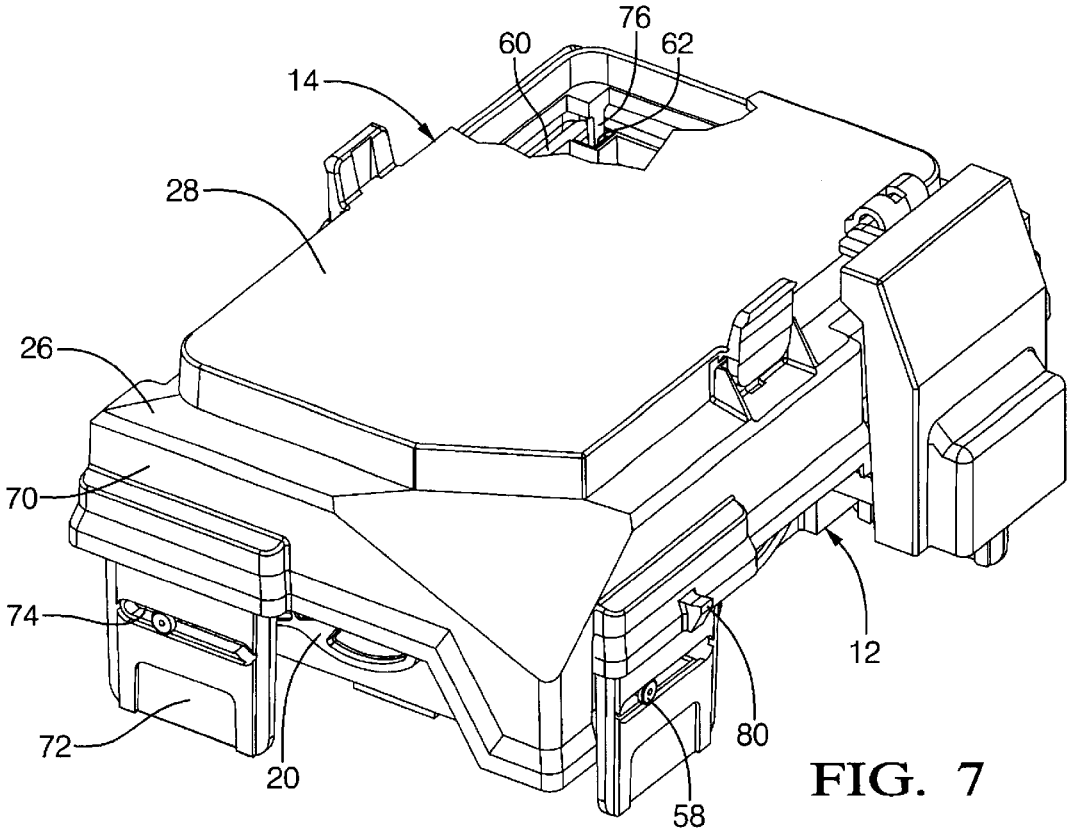
FIG. 7 is a perspective, cut-away view showing a second aspect of the present invention in a pre-stage position.

FIG. 7 illustrates the electrical distribution center member 12, driver member 14, and the cam levers 20 assembled in the first pre-stage combination 102. In this position, the electrical distribution center member 12 is attached to the driver member 14 by the shoulders 78 (not shown on FIG. 7) of the first prestage lock arms 76 engaging with the first pre-stage lock receiving sockets 62. The first pre-stage combination 102 is suitable for shipping.

In a separate step, an assembler places the connector assemblies 18 which are connected to an associated wiring harness (not shown) in the support member 16 so that each of the connector assemblies 18 is received in a respective bay (not shown). In a preferred embodiment, each of the connector assemblies 18 snap fit into the support member 16.

A second pre-stage assembly step includes an assembler aligning the first pre-stage combination 102 with the support member 16, then pushing them together, engaging the shoulders 68 of the second pre-stage lock arms 64 with the second pre-stage lock receiving sockets 92. The guide slots 84 in the support member 16 receive the downward extending alignment projections 72 of the upper housing 26.

Figure 8:
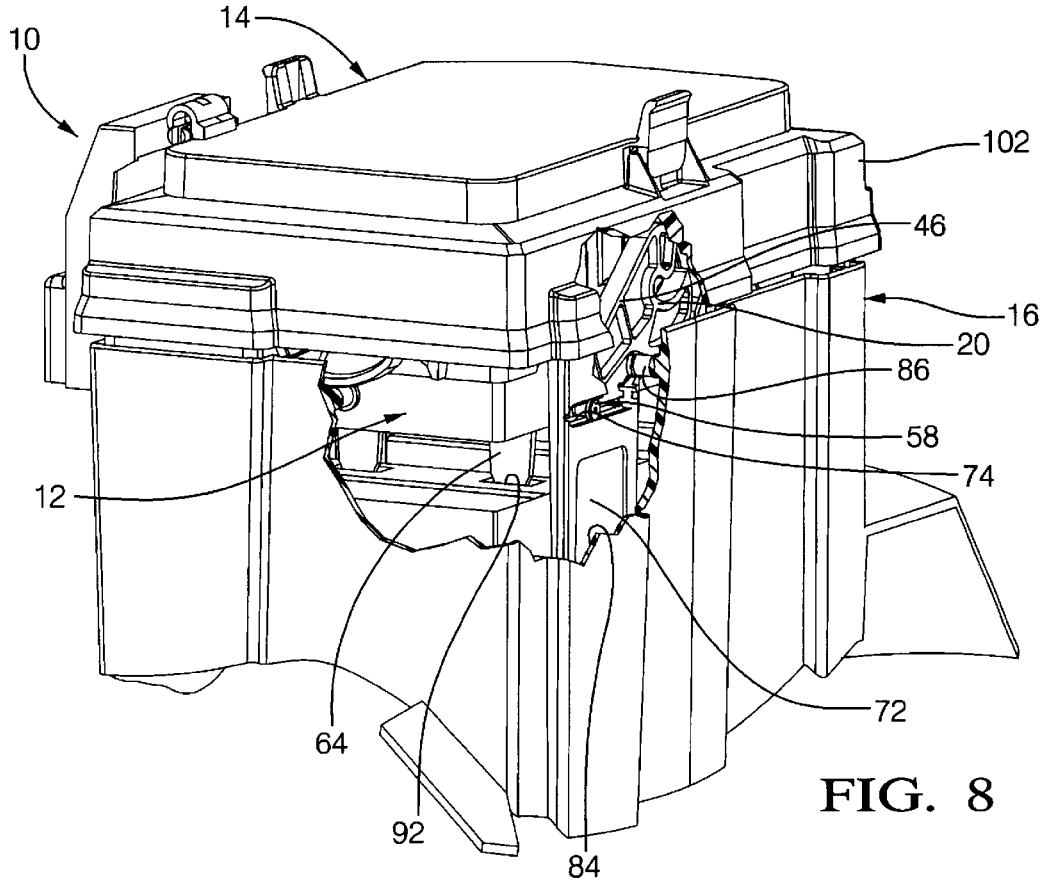
FIG. 8 is a perspective, cut-away view showing an electrical distribution center assembly of the present invention in another pre-stage position.

FIG. 8 illustrates the electrical distribution center assembly 10 in a second pre-stage position. The first pre-stage combination 102 is positioned above the connector assemblies 18 and support member 16. The boss 58 formed on each of the lever arms 46 extends into a respective one of the slots 74 formed in the driver member 14. Each of the second pre-stage lock arms 64 is engaged with a respective one of the second pre-stage lock receiving sockets 92 on the support member 16. The downward extending alignment projections 72 of the upper housing 26 are received in the guide slots 84 formed in the support member 16.

In a first connecting step, an assembler applies an upward engagement force pulling the driver member 14 away from the support member 16, thereby causing the electrical distribution center member 12 to draw closer to the electrical connectors 22. The upward engagement force applied to the driver member 14 causes a first engagement movement of the driver member 14 relative to the support member 16. As the driver member 14 moves away from the support member 16, the alignment projections 72 slide through the guide slots 84 to guide the driver member 16 along the connection axis CA. The driver member 14 abuts against the boss 58 on each of the lever arms 46 rotating each of the cam levers 20 in a first direction and also causing the shoulders 78 of the first pre-stage lock arms 76 to disengage from the first pre-stage lock receiving sockets 62. The engagement of the shoulders 68 of the second pre-stage lock arms 64 with the second pre-stage lock receiving sockets 92 prevents the electrical distribution center member 12 from moving away from the support member 16 and maintains the electrical distribution center member 12 at a position relative to the support member 16 such that the hook portion 57 of each of the cam levers 20 can capture the corresponding cam guide projection 86 as described below. As the cam levers 20 rotate, each boss 58 slides within the corresponding slots 74 formed in the driver member 14. As the cam levers 20 continue to rotate, each of the cam guide projections 86 engages the hook portion 57 of the corresponding cam lever 20 and is received in a respective opening 56 of a corresponding one of the cam tracks 48. As the cam guide projection 86 slides through the second track portion 52 the enlarged head **86*b* of the cam guide projection 86 abuts the hook portion 57 of the cam lever 20 enabling each of the cam levers 20 to function as a hook and assist with the retention and alignment of the electrical distribution center member 12 with the support member 16 as the driver member 14 is pulled away. The slot 59 formed in the cam lever 20 provides clearance for the enlarged head 86*b* as it slides through the second track portion 52. The second track portion 52 also functions as a cam. As the cam guide projection 86 slides through the second track portion 52 the cam guide projection 86 moves closer to the rotational center 45 of the cam lever 20, thereby drawing the electrical distribution center member 12 toward the electrical connectors 22 attached to the support member 16. The cam levers 20 multiply the upward engagement force drawing the electrical distribution center member 12 toward the electrical connectors 22. The positioning of the cam levers 20 on first and second sets of opposing walls 44*a*, 44*c*; 44*b*, 44*d* functions to distribute the engagement forces and minimize torquing of the electrical distribution center member 12 as it encounters resistance during its movement. Once the movement of the electrical distribution center member 12 begins, the second pre-stage lock arms 64 correspondingly move, thereby disengaging each of the shoulders 68 from the respective second pre-stage lock receiving sockets 92 on the support member 16. The second track portion 52 also serves an alignment function as the driver member 14 is pulled away from the electrical distribution center member 12 in that the second track portion 52 aligns the cam guide projections 86 with the respective first track portions 50. During this step, the electrical connectors 22 enter the connector shrouds 42 and may abut the chamfered rim 40 defining the opening of the shrouds 42. The gap 90 between the electrical distribution center member 12 and the support member 16 provides space to enable the electrical distribution center member 12 to move into alignment with the electrical connectors 22. The assembler pulls the driver member 14 away from the support member 16 until the interference occurs that signals the assembler to stop pulling the driver member 14. In this embodiment, the interference is a tactile, sensed interference caused by the cam guide projection 86 abutting the end surface 54 of the second track portion 52**.

Figure 9:
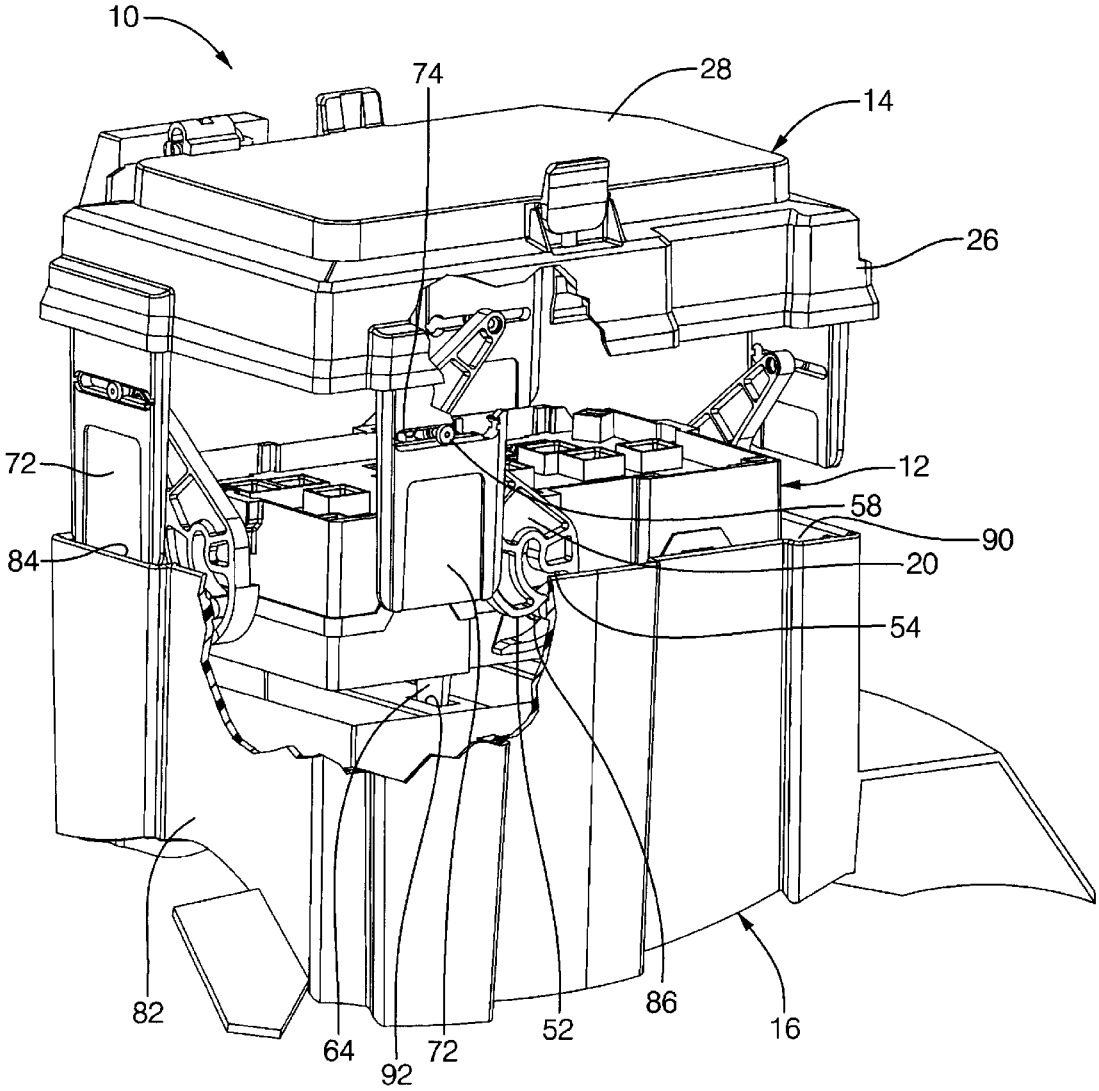
FIG. 9 is a perspective, cut-away view showing an electrical distribution center assembly of the present invention in yet another pre-stage position.

FIG. 9 illustrates the electrical distribution center assembly 10 in an intermediate engagement position following the first connecting step. The electrical distribution center member 12 is in a pre-mating position substantially aligned with the electrical connectors 22. The shoulder 68 of each of the second pre-stage lock arms 64 extends through, but is no longer engaged with, the corresponding second pre-stage lock receiving socket 92 on the support member 16. The boss 58 formed on each of the lever arms 46 extends into a respective one of the slots 74 formed in the driver member 14. The cam lever 20 is rotated from the second pre-stage position. The cam guide projections 86 project into the second track portion 52 of the cam lever 20. At least one of the alignment projections 72 is engaged with a corresponding guide slot 84.

In a second connecting step, an assembler applies a downward engagement force pressing the driver member 14 toward the support member 16, thereby causing the electrical distribution center member 12 to draw toward the electrical connectors 22 until they are fully mated. The downward engagement force applied to the driver member 14 causes a second engagement movement of the driver member 14 relative to the support member 16. This causes the driver member 14 to abut against the boss 58 formed on each of the lever arms 46 causing the cam levers 20 to rotate in a second direction opposite the first direction with each boss 58 sliding within a respective slot 74 formed in the driver member 14. Rotational movement of the cam lever 20 causes each of the cam guide projections 86 to project into the first track portion 50 of the cam lever 20 with the body 86*a* of each of the cam guide projections 86 abutting the cam lever 20. Continued engagement movement of the driver member 14 causes each of the respective cam guide projections 86 to slide within the first track portion 50. As the cam guide projection 86 slides through the first track portion 50 toward the cam track end surface 49, the cam guide projection 86 moves closer to the rotational center 45 of the cam lever 20 thereby drawing the electrical distribution center member 12 toward the electrical connectors 22 until the electrical distribution center member 12 fully mates with the electrical connectors 22. As the driver member 14 moves toward the support member 16, the alignment projections 72 slide through the guide slots 84 to guide the driver member 16 along the connection axis CA. The cam levers 20 multiply the downward engagement force drawing together the electrical distribution center member 12 and the electrical connectors 22 against a mechanical resistance such as the resistance caused by the frictional engagement of the male blades 36 with the terminals 100 mounted in each of the connectors 22. The shoulder 96 of each flexible lock arm 94 latches onto the respective latch nib 80 releasably locking the driver member 14 to the support member 16. The assembler may then perform other steps such as attaching a power source (not shown) to the electrical distribution center member 12.

Figure 12:
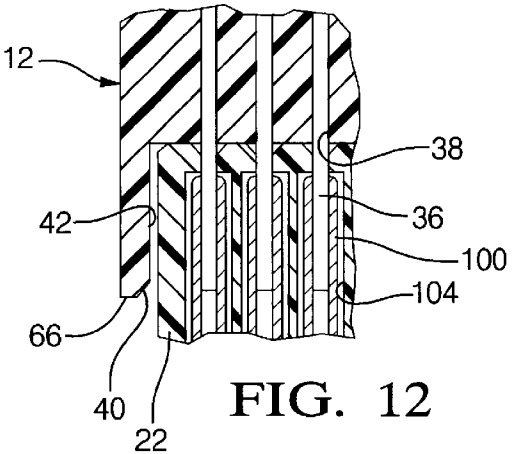
FIG. 12 is a fractional cross-section view illustrating a third aspect of the present invention.
Figure 10:
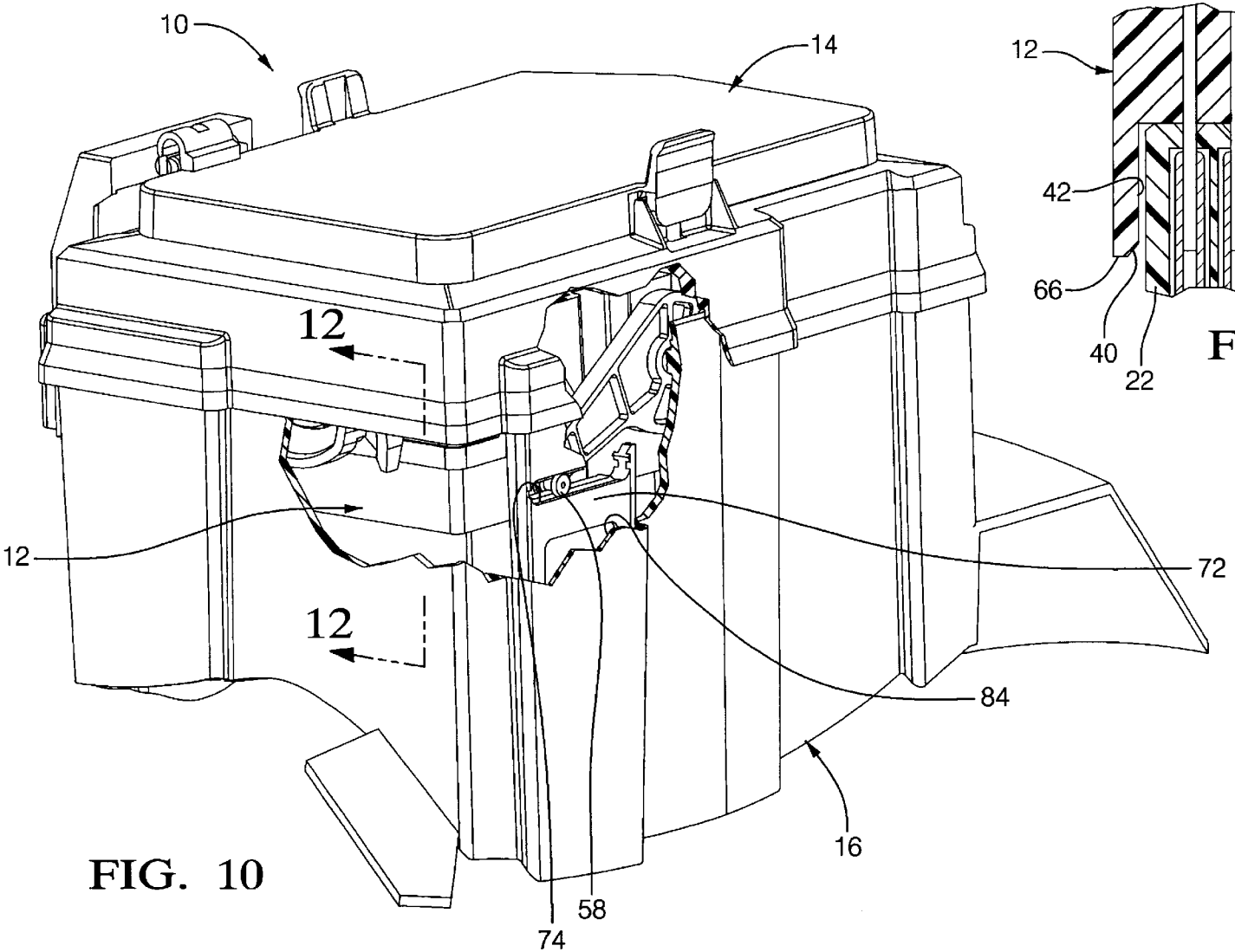
FIG. 10 is a perspective, cut-away view showing an assembled electrical distribution center assembly of the present invention.
Figure 11:
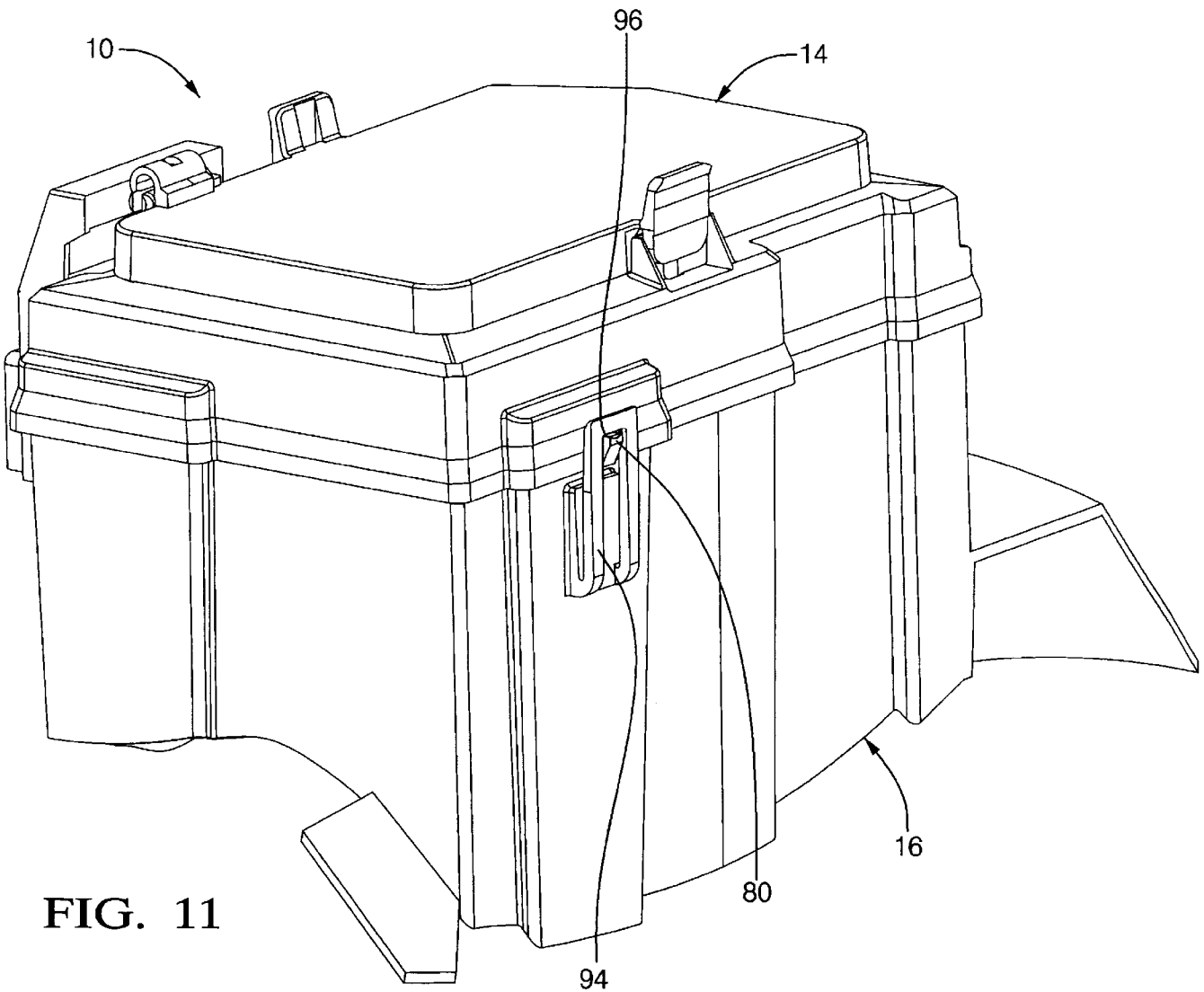
FIG. 11 is a perspective view showing an assembled electrical distribution center assembly of the present invention.

FIGS. 10 through 12 illustrate the electrical distribution center assembly 10 in an engaged state. The boss 58 formed on each of the lever arms 46 extends into a respective one of the slots 74 formed in the driver member 14. The cam guide projections 86 extend into the first track portion 50 of the cam lever 20. Each male blade 36 extends into a respective one of the terminals 100 mounted in the connector cavities 104. The shoulder 96 of each lock arm 94 engages a respective lock nib 80.

The electrical distribution center member 12 may be electrically disconnected from each of the electrical connectors 22 by disengaging the shoulder 96 of each flexible lock arm 94 from the respective latch nib 80. An operator may then apply a disengagement force by pulling upward on the driver member 14 thereby causing disengagement movement of the driver member 14 relative to the support member 16. Continued disengagement movement of the driver member 14 causes the driver member 14 to abut against the boss 58 on each of the cam levers 20 causing the cam levers 20 to rotate in the first direction with each of the cam guide projections 86 sliding within the respective first track portion 50 of each cam lever 20. The cam levers 20 multiply the disengagement force separating the electrical distribution center member 12 and the connectors 22 against a mechanical resistance such as the resistance caused by the frictional disengagement of the male blades 36 from the terminals 100 mounted in the connectors 22.

This invention has been described with reference to a preferred embodiment and modifications thereto. Further modifications and alterations may occur to others upon reading and understanding the specification. It is intended to include all such modifications and alterations insofar as they come within the scope of the invention. For example, the preferred embodiment of the invention includes cam levers 20 which have first and second track portions 50, 52. However, other cam track designs including cam tracks which have more or less than two track portions may occur to one skilled in the art without deviating from the scope of the present invention.

Having thus described the invention, what is claimed is:

1. An electrical distribution center assembly comprising:

at least one electrical connector;

an electrical distribution center member mateable with said at least one electrical connector in a direction parallel with respect to a connection axis;

a support member supporting said at least one electrical connector in a position and orientation to enable said at least one electrical connector to mate with said electrical distribution center member, said support member comprising side walls and a plurality of internal cam guide projections, each extending from a respective one on an inside of said side walls;

a plurality of cam levers, each of said cam levers rotatably attached to a respective side of said electrical distribution center member, each of said cam levers being rotatable around a respective rotation axis, each rotation axis extending generally orthogonally with respect to said connection axis, each of said cam levers including an arm and a cam track, said cam track having a first portion shaped to gradually approach said respective rotation axis to urge said cam guide projection toward said corresponding rotation axis as said cam lever rotates in a first rotational direction; and a driver member positioned on a top portion of said electrical distribution center member to abut each of said arms, said driver member linearly movably engaged with said support member, wherein said driver member being movable along a path generally parallel with respect to said connection axis, whereby movement in a first axial direction causes said driver to abut said arms to cause said cam levers to rotate in said first rotational direction, wherein when said electrical distribution center member is positioned in a pre-mating position, whereby said cam guide projections are each projected into said first portion of a respective one of said cam tracks, said plurality of cam levers support said electrical distribution center member in substantial alignment with said at least one electrical connector with respect to said connection axis, an engagement force applied to said driver member in said first axial direction moves said driver member to cause said cam levers to rotate in said first rotational direction and multiply said engagement force to overcome a resistance and cause said electrical distribution center member and said at least one electrical connector to be engaged.

2. The electrical distribution center assembly of claim 1, wherein said electrical distribution center member comprises at least one connector shroud for guidably receiving said at least one electrical connector.

3. The electrical distribution center assembly of claim 2, wherein said support member comprises at least one guide slot formed in said side walls.

4. The electrical distribution center assembly of claim 3, wherein said driver member includes at least one projection for engaging said at least one guide slot.

5. The electrical distribution center of claim 1, wherein said support member comprises a splash shield for said electrical distribution center member.

6. The electrical distribution center assembly of claim 1, wherein said driver member comprises a cover for said electrical distribution center member.

7. An electrical distribution center assembly comprising:

at least one electrical connector;

an electrical distribution center member mateable with said at least one electrical connector, said electrical distribution center member including at least one connector shroud for guidably receiving said electrical connector in a direction parallel with respect to a connection axis;

a support member supporting said at least one electrical connector in a position and orientation to enable said at least one electrical connector to mate with said electrical distribution center member, said support member including at least one cam guide projection extending from an inside of a wall thereof and a first guide member;

at least one cam lever rotatably attached to said electrical distribution center member, said at least one cam lever being rotatable around a respective rotation axis, each of said at least one rotation axis extending generally orthogonally with respect to said connection axis, each of said at least one cam lever including an arm and a cam track, said cam track having a first portion shaped to gradually approach said respective rotation axis to urge said cam guide projection toward said rotation axis as said cam lever rotates in a first rotational direction; and a driver member positioned on a top portion of said electrical distribution center member and engageable with said first guide member to guide a movement of said driver member along a path aligned generally parallel with respect to said connection axis, said driver member being formed to abut said at least one arm such that a movement of said driver member in a first axial direction along said path causes said at least one cam lever to rotate in said first rotational direction, wherein when said at least one cam guide projection is projected into said first portion of said cam track, said first guide member is engaged with said driver member, said electrical connector is received in said connector shroud, and said driver member abuts said at least one arm, an engagement force applied to said driver member causes said driver member to move along said path in said first axial direction, whereby said driver member causes said at least one cam lever to rotate and multiply said engagement force to overcome a resistance and cause said electrical distribution center member and said at least one electrical connector to be engaged.

8. The electrical distribution center assembly of claim 7, wherein each of said at least one arm includes a boss, said driver member includes at least one slot, wherein each of said at least one boss projects into a respective one of said at least one slot enabling said driver member to abut each of said at lea one arm to cause said first rotational movement.

9. The electrical distribution center assembly of claim 8, wherein said at least one slot extends generally orthogonally with respect to said connection axis and a corresponding one of said at least one rotation axis.

10. The electrical distribution center assembly of claim 9, wherein said at least one socket has an opening defined by a chamfered rim to facilitate alignment of said electrical connector with said socket.

11. The electrical distribution center assembly of claim 8, wherein said electrical distribution center member includes two opposing walls, said at least one cam lever includes at least two cam levers, each rotatably attached to a respective one of said opposing walls, said at least one cam guide projection comprises at least two cam guide projections, each engageable with a respective one of said at least two cam levers.

12. An electrical distribution center assembly comprising:

at least one electrical connector;

an electrical distribution center member mateable along a connection axis with said at least one electrical connector;

a support member supporting said at least one electrical connector in a position extending from inside of walls thereof and orientation to enable said at least one electrical connector to mate with said electrical distribution center member, said support member including a plurality of cam guide projections and a first guide member;

a plurality of spaced apart cam levers rotatably attached to said electrical distribution center member, each of said cam levers being rotatable around a respective rotation axis, each said rotation axis extending generally orthogonally with respect to said connection axis, each of said cam levers including an arm and a cam track, said arm including a boss, said cam track having a first portion shaped to gradually approach said respective rotation axis to urge said cam guide projection toward said rotation axis as said cam lever rotates in a first rotational direction; and a driver member engageable with said first guide member to guide movement of said driver member positioned on a top portion of said electrical distribution center member and along a path aligned generally parallel with respect to said connection axis, said driver member including a plurality of slots, each for receiving a respective one of said at least one boss, wherein movement of said driver member in a first direction along said path axially away from said support member causes said cam levers to rotate in said first rotational direction, wherein during a first connecting step, each of said cam guide projections being projected into said first portion of said respective cam track, whereby said cam levers support said electrical distribution center member, said first guide member being engaged with said driver member, and each of said bosses being engaged with a respective one of said slots, a first engagement force applied to said driver member sufficient to pull said driver member away from said support member to an intermediate connection position causes said driver member to move along said path in said first direction, wherein said driver member causes said cam levers to rotate in said first rotational direction and multiply said first engagement force to overcome a resistance and draw said electrical distribution center member axially toward an engage with said at least one electrical connector.

13. The electrical distribution center assembly of claim 12, wherein each said cam track further includes a second portion shaped to gradually approach said respective rotation axis to urge said cam guide projection toward said rotation axis as said cam lever rotates in a second rotational direction opposite said first rotational direction, said second portion being in communication with said first portion, wherein during a second connecting step, a second engagement force applied to said driver member sufficient to push said driver member along said path toward said support member to a final position causes each of said cam follower projections to engage a respective one of said second track portions and thereby cause said cam levers to rotate in said second rotational direction multiplying said second engagement force to overcome a resistance and mate said electrical distribution center member and said at least one electrical connector.

14. The electrical distribution center assembly of claim 13, wherein said driver member includes a projection and said first guide member comprises a guide slot for engaging said projection.

15. The electrical distribution center assembly of claim 13, wherein said electrical distribution center member includes at least one connector socket for guidably receiving said electrical connector.

16. The electrical distribution center assembly of claim 15, wherein said at least one connector socket has an opening defined by a chamfered rim to facilitate alignment of said electrical connector with said socket.

17. The electrical distribution center assembly of claim 13, wherein said driver member includes a first lock arm, said electrical distribution center member includes a first lock arm socket, said first lock arm and said first lock arm socket being capable of cooperating to releasably affix said driver member to said electrical distribution center member in a first pre-stage position.

18. The electrical distribution center assembly of claim 14, wherein said electrical distribution center member includes a second lock arm, said support member includes a second lock arm socket, said second lock arm and said second lock arm socket being capable of cooperating to releasably affix said electrical distribution center member to said support member in a second prestage position.

19. The electrical distribution center assembly of claim 12, wherein said support member comprises a splash shield which receives said electrical distribution center member.

20. The electrical distribution center assembly of claim 12, wherein said driver member comprises a cover for said electrical distribution center member.

21. An electrical distribution center assembly comprising:

an electrical connector;

a support member having vertical walls supporting said electrical connector, said support member comprising a structure in which a plurality of cam guide projections are formed on inside walls of the support member;

an actuating driver member having downward extending alignment projections linearly movably engaged with said support member in a direction substantially parallel with said vertical walls;

an electrical distribution center member mateable with said electrical connector, said electrical distribution center member comprising a housing; and a plurality of cam levers rotatably attached to said housing, each cam lever including an arm formed for abutment with said driver member, each cam lever further including a cam track formed therein engaged with a respective one of said cam guide projections, said cam levers supporting said electrical distribution center member when said electrical distribution center member is in a pre-mating position, wherein when said electrical distribution center member is in said pre-mating position an engagement movement of said driver member toward said electrical connector causes said driver member to abut said arms causing said cam levers to rotate thereby mating said electrical distribution center member with said electrical connector.

22. The electrical distribution center assembly of claim 21, wherein said cam track having a first portion shaped to gradually approach a rotation axis of said cam lever.

23. The electrical distribution center assembly of claim 22, wherein said electrical distribution center member comprises a connector shroud for guidably receiving said electrical connector.

24. The electrical distribution center assembly of claim 23, wherein a plurality of slots are formed in said driver member, each of said arms include a boss, each said boss is slidably mounted in a respective one of said slots.

25. A method for mating an electrical distribution center member with an electrical connector comprising:

providing a support member having at least one cam guide projection, extending from an inside wall thereof an electrical connector attached to said support member, an electrical distribution center member mateable with said electrical connector, at least one cam lever rotatably attached on said electrical distribution center member, each of said at least one cam lever including an arm and a cam track, said at least one cam guide projection being capable of projecting into a respective one of said at least one cam track for drawing together said electrical distribution center member and said at least one connector in response to a rotational movement of said cam lever, and a driver member having at least one downward extending alignment projection capable of abutting said at least one arm such that an engagement movement of said at least one downward extending alignment projection of said driver member relative to said at least one arm causes said rotational movement, said cam lever being operable to increase an engagement force by leverage;

projecting said at least one cam guide projection into said cam track;

abutting said downward extending alignment projection against said arm; and applying said engagement force to said driver member to cause said engagement movement until said electrical distribution center member and said electrical connector are mated.

* * * * *